US007691801B2

(12) United States Patent
Briggs et al.

(10) Patent No.: US 7,691,801 B2
(45) Date of Patent: Apr. 6, 2010

(54) LAUNDRY PRODUCT

(75) Inventors: Stephen Leonard Briggs, Wirral (GB); Craig Warren Jones, Wirral (GB); Glyn Roberts, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 385 days.

(21) Appl. No.: 11/807,556

(22) Filed: May 29, 2007

(65) Prior Publication Data

US 2007/0287658 A1 Dec. 13, 2007

(30) Foreign Application Priority Data

May 31, 2006 (GB) ..... 0610801.3

(51) Int. Cl.
*C11D 1/83* (2006.01)

(52) U.S. Cl. ..... 510/471; 510/481; 510/491; 510/505

(58) Field of Classification Search ..... 510/471, 510/481, 491, 505
See application file for complete search history.

(56) References Cited

U.S. PATENT DOCUMENTS

| | | | | |
|---|---|---|---|---|
| 2,566,359 | A | 1/1947 | Owen | 260/413 |
| 4,386,213 | A | 5/1983 | Giesecke et al. | |
| 4,569,773 | A | 2/1986 | Ramachandran et al. | 252/8.7 |
| 4,605,506 | A | 8/1986 | Wixon | 252/8.75 |
| 4,775,492 | A | 10/1988 | Vipond et al. | 252/187.26 |
| 4,818,421 | A | 4/1989 | Boris et al. | 252/8.8 |
| 4,851,138 | A | 7/1989 | Jaroschek et al. | 252/88 |
| 5,225,100 | A | 7/1993 | Fry et al. | 252/174.25 |
| 5,507,970 | A | 4/1996 | Ishikawa et al. | |
| 5,972,870 | A | 10/1999 | Anderson | 510/298 |
| 6,391,845 | B1 | 5/2002 | Speed et al. | |
| 6,486,117 | B1 | 11/2002 | Painter et al. | |
| 6,566,115 | B1 | 5/2003 | Weisgerber et al. | 435/221 |
| 6,610,640 | B1 | 8/2003 | Zappone et al. | |
| 6,727,220 | B1 | 4/2004 | Grainger et al. | 510/475 |
| 6,815,410 | B2 | 11/2004 | Boutique et al. | |
| 7,083,047 | B2 | 8/2006 | Bone et al. | |
| 7,115,173 | B2 | 10/2006 | Caswell et al. | |
| 2001/0018410 | A1 | 8/2001 | Grainger et al. | 510/515 |
| 2001/0034315 | A1 | 10/2001 | Grainger et al. | 510/327 |
| 2001/0053754 | A1 | 12/2001 | Hewitt et al. | |
| 2002/0013243 | A1 | 1/2002 | Hewitt et al. | |
| 2002/0198125 | A1 | 12/2002 | Jones | 510/296 |
| 2003/0054966 | A1 | 3/2003 | Bone et al. | 510/296 |
| 2003/0134766 | A1 | 7/2003 | Jones et al. | 510/293 |
| 2003/0199414 | A1* | 10/2003 | Boutique et al. | 510/293 |
| 2003/0199415 | A1 | 10/2003 | Mondin | 510/293 |
| 2004/0063928 | A1* | 4/2004 | Jo | 536/119 |
| 2004/0115375 | A1 | 6/2004 | Duffield et al. | 428/34.1 |
| 2006/0205631 | A1 | 9/2006 | Smerznak et al. | |
| 2008/0242579 | A1 | 10/2008 | Briggs et al. | |
| 2008/0242580 | A1 | 10/2008 | Briggs et al. | |
| 2008/0261850 | A1 | 10/2008 | Briggs et al. | |

FOREIGN PATENT DOCUMENTS

| | | | |
|---|---|---|---|
| AU | 14416/88 | B | 10/1988 |
| CA | 2 450 149 | A1 | 12/2002 |
| CA | 2 562 113 | A1 | 10/2005 |
| CA | 2 583 298 | A1 | 5/2006 |
| EP | 0 845 523 | A2 | 6/1998 |
| EP | 1 431 381 | | 6/2004 |
| EP | 1 431 383 | B1 | 3/2006 |
| EP | 1 486 559 | | 5/2006 |
| FR | 2 780 411 | | 12/1999 |
| GB | 1 235 292 | | 6/1971 |
| GB | 1 598 102 | | 9/1981 |
| GB | 2 204 608 | A | 11/1988 |
| GB | 2 247 463 | | 3/1992 |
| JP | 2001-40398 | A | 2/2001 |
| WO | WO 95/22594 | A1 | 8/1995 |
| WO | 98/16538 | | 4/1998 |
| WO | 02/102955 | | 12/2002 |
| WO | 02/102956 | | 12/2002 |
| WO | WO 02/097026 | A1 | 12/2002 |
| WO | 2004/011589 | | 2/2004 |
| WO | 2006/037469 | | 4/2006 |
| WO | 2006/045391 | | 5/2006 |
| WO | 2006/076952 | | 7/2006 |

OTHER PUBLICATIONS

Derwent Abstract of FR 2 780 411, published Dec. 31, 1999.

Derwent Abstract of JP 2001 040398.

Thomssen et al., "*Soaps and Detergents*", MacNair-Dorland Company, (1949), pp. 259-269.

Allen, D. K. et al., "Carbohydrate-Alkyl Ester Derivatives as Biosurfactants," *Journal of Surfactants and Detergent*, 2:383-390 Springer, Berlin / Heidelberg, Germany (1999).

English languange Abstract for JP 2001-040398 A, published Feb. 13, 2001, Japanese Patent Office, Patent & Utility Model Gazette DB.

International Search Report for International Application No. PCT/EP2005/006517, European Patent Office, Rijswijk, Netherlands, mailed on Oct. 10, 2005 (3 pages).

International Search Report for International Application No. PCT/EP2005/010402, European Patent Office, Rijswijk, Netherlands, mailed on Jan. 12, 2006 (3 pages).

International Search Report for International Application No. PCT/EP2007/055131, European Patent Office, Rijswijk, Netherlands, mailed on Sep. 25, 2007 (2 pages).

(Continued)

*Primary Examiner*—John R Hardee
(74) *Attorney, Agent, or Firm*—Sterne, Kessler, Goldstein & Fox P.L.L.C.

(57) ABSTRACT

A liquid fabric treatment composition comprising from 50 to 92% by weight of water, from 1 to 15% by weight of one or more alkylated sugars, from 1 to 15% by weight of one or more fatty acids, from 5 to 25% by weight of one or more fatty acid esters, and from 1 to 15% by weight of fatty acid soap.

20 Claims, No Drawings

OTHER PUBLICATIONS

Maag, H., "Fatty Acid Derivatives: Important Surfactants for Household, Cosmetic and Industrial Purposes," *Journal of the American Oil Chemists' Society 61*:259-267 Springer, Berlin / Heidelberg, Germany (1984).
Search Report completed Nov. 18, 2004, for Great Britain Application No. GB0416155.0 (1 page).
Search Report completed Mar. 4, 2005, for Great Britain Application No. GB0422026.5 (1 page).
Search Report completed Mar. 16, 2005, for Great Britain Application No. GB0423986.9 (1 page).
Search Report completed Sep. 26, 2006, for Great Britain Application No. GB0610801.3 (1 page).

* cited by examiner

LAUNDRY PRODUCT

FIELD OF THE INVENTION

This invention relates to laundry products, and in particular relates to unit dose fabric treatment systems.

BACKGROUND OF THE INVENTION

Our co-pending PCT Application No. PCT EP2005 010187 disclosed a fabric treatment system in the form of a unit dose comprising:

(a) a water soluble container capable of dissolving in a wash liquor which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers; and (b) a liquid fabric treatment composition disposed in said water soluble container, wherein said fabric treatment composition comprises;

(i) one or more fatty acids;

(ii) one or more alkylated sugars;

(iii) optionally a fatty acid soap;

(iv) optionally one or more fatty acid esters;

(v) optionally perfume, and (vi) optionally a cationic cellulose ether deposition polymer, The composition is present in an amount within the water-soluble container which is sufficient to form a unit dose capable of providing effective softening, conditioning or other laundry treatment of fabrics in said washing machine.

Co-pending PCT Patent Application No. PCT/EP2005/010402 discloses a method of preparing a composition for use in a fabric treatment system in the form of a unit dose comprising:

(a) a water soluble container which is formed from a water soluble polymer selected from the group consisting of polyvinyl alcohols, polyvinyl alcohol copolymers, partially hydrolyzed polyvinyl acetate, polyvinyl pyrrolidone, alkyl celluloses, ethers and esters of alkyl cellulosics, hydroxy alkyl, carboxy methyl cellulose sodium, dextrin, maltodextrin, water soluble polyacrylates, water soluble polyacrylamides and acrylic acid/maleic anhydride copolymers; and (b) a liquid fabric treatment composition disposed in said water soluble container, wherein said fabric treatment composition comprises:

(i) one or more soaps, and (ii) optionally a plasticiser the method comprising the steps of reacting together, in the presence of water, (i) an ester-containing soap precursor, (ii) a base material, and (iii) optionally a solvent It has now been found that such compositions may be formulated with water to be supplied in a container and dosed in the rinse e.g. into the drawer of an automatic washing machine.

STATEMENT OF THE INVENTION

According to the present invention there is provided a liquid fabric treatment composition comprising (i) from 50 to 92% by weight of water (ii) from 1 to 15% by weight of one or more alkylated sugars (iii) from 1 to 15% by weight of one or more fatty acids (iv) from 5 to 25% by weight of one or more fatty acid esters, and (v) from 1 to 15% by weight of fatty acid soap.

DETAILED DESCRIPTION OF THE INVENTION

Alkylated Sugar

The alkylated sugar, also referred to as an oily sugar derivative, is a liquid or soft solid derivative of a cyclic polyol or of a reduced saccharide. The sugar is typically is typically derivatised by esterifying or etherifying from 10 to 100%, more preferably 20 to 100%, e.g. from 35 to 100% of the hydroxyl groups in the polyol or saccharide. The derivative usually has two or more ester or ether groups independently attached to a $C_8$-$C_{22}$ alkyl or alkenyl chain.

The oily sugar derivatives of the invention are also referred to herein as "derivative-CP" and "derivative-RS" dependent upon whether the derivative is a product derived from a cyclic polyol or from a reduced saccharide starting material respectively.

Preferably the derivative-CP and derivative-RS contain 35% by weight tri or higher esters, e.g. at least 40%.

Preferably 35 to 85% most preferably 40 to 80%, even more preferably 45 to 75%, such as 45 to 70% of the hydroxyl groups in said cyclic polyol or in said reduced saccharide are esterified or etherified to produce the derivative-CP and derivative-RS respectively.

For the derivative-CP and derivative-RS, the tetra, penta etc prefixes only indicate the average degrees of esterification or etherification. The compounds exist as a mixture of materials ranging from the monoester to the fully esterified ester. It is the average degree of esterification as determined by weight that is referred to herein.

The derivative-CP and derivative-RS used do not have substantial crystalline character at 20° C. Instead they are preferably in a liquid or soft solid state, as hereinbelow defined, at 20° C.

The starting cyclic polyol or reduced saccharide material is esterified or etherified with $C_8$-$C_{22}$ alkyl or alkenyl chains to the appropriate extent of esterification or etherification so that the derivatives are in the requisite liquid or soft solid state. These chains may contain unsaturation, branching or mixed chain lengths.

Typically the derivative-CP or derivative-RS has 3 or more, preferably 4 or more, for example 3 to 8, e.g. 3 to 5, ester or ether groups or mixtures thereof. It is preferred if two or more of the ester or ether groups of the derivative-CP and derivative-RS are independently of one another attached to a $C_8$ to $C_{22}$ alkyl or alkenyl chain. The alkyl or alkenyl groups may be branched or linear carbon chains.

The derivative-CPs are preferred for use as the oily sugar derivative. Inositol is a preferred cyclic polyol, and Inositol derivatives are especially preferred.

In the context of the present invention the terms derivative-CP and derivative-RS encompass all ether or ester derivatives of all forms of saccharides, which fall into the above definition. Examples of preferred saccharides for the derivative-CP and derivative-RS to be derived from are monosaccharides and disaccharides.

Examples of monosaccharides include xylose, arabinose, galactose, fructose, sorbose and glucose. Glucose is especially preferred. An example of a reduced saccharide is sorbitan. Examples of disaccharides include maltose, lactose, cellobiose and sucrose. Sucrose is especially preferred.

If the derivative-CP is based on a disaccharide it is preferred if the disaccharide has 3 or more ester or ether groups attached to it. Examples include sucrose tri, tetra and penta esters.

Where the cyclic polyol is a reducing sugar it is advantageous if each ring of the derivative-CP has one ether group, preferably at the $C_1$ position. Suitable examples of such compounds include methyl glucose derivatives.

Examples of suitable derivative-CPs include esters of alkyl (poly)glucosides, in particular alkyl glucoside esters having a degree of polymerisation from 1 to 2.

The HLB of the derivative-CP and derivative-RS is typically between 1 and 3.

The derivative-CP and derivative-RS may have branched or linear alkyl or alkenyl chains (with varying degrees of branching), mixed chain lengths and/or unsaturation. Those having unsaturated and/or mixed alkyl chain lengths are preferred.

One or more of the alkyl or alkenyl chains (independently attached to the ester or ether groups) may contain at least one unsaturated bond.

For example, predominantly unsaturated fatty chains may be attached to the ester/ether groups, e.g. those attached may be derived from rape oil, cotton seed oil, soybean oil, oleic, tallow, palmitoleic, linoleic, erucic or other sources of unsaturated vegetable fatty acids.

The alkyl or alkenyl chains of the derivative-CP and derivative-RS are preferably predominantly unsaturated, for example sucrose tetratallowate, sucrose tetrarapeate, sucrose tetraoleate, sucrose tetraesters of soybean oil or cotton seed oil, cellobiose tetraoleate, sucrose trioleate, sucrose triapeate, sucrose pentaoleate, sucrose pentarapeate, sucrose hexaoleate, sucrose hexarapeate, sucrose triesters, pentaesters and hexaesters of soybean oil or cotton seed oil, glucose trioleate, glucose tetraoleate, xylose trioleate, or sucrose tetra-,tri-, penta- or hexa-esters with any mixture of predominantly unsaturated fatty acid chains.

However some derivative-CPs and derivative-RSs may be based on alkyl or alkenyl chains derived from polyunsaturated fatty acid sources, e.g. sucrose tetralinoleate. It is preferred that most, if not all, of the polyunsaturation has been removed by partial hydrogenation if such polyunsaturated fatty acid chains are used.

The most highly preferred liquid or soft solid derivative-CPs and derivative-RSs are any of those mentioned in the above three paragraphs but where the polyunsaturation has been removed through partial hydrogenation.

Particularly effective derivative-CPs and derivative-RSs are obtained by using a fatty acid mixture (to react with the starting cyclic polyol or reduced saccharide) which comprises a mixture of tallow fatty acid and oleyl fatty acid in a weight ratio of 10:90 to 90:10, more preferably 25:75 to 75:25, most preferably 30:70 to 70:30. A fatty acid mixture comprising a mixture of tallow fatty acid and oleyl fatty acid in a weight ratio of 60:40 to 40:60 is especially preferred.

Particularly preferred are fatty acid mixtures comprising a weight ratio of approximately 50 wt % tallow chains and 50 wt % oleyl chains. It is especially preferred that the fatty acid fieldstock for the chains consists of only tallow and oleyl fatty acids.

Preferably 40% or more of the chains contain an unsaturated bond, more preferably 50% or more, most preferably 60% or more e.g. 65% 95%.

Oily sugar derivatives suitable for use in the compositions include sucrose pentalaurate, sucrose tetraoleate, sucrose pentaerucate, sucrose tetraerucate, and sucrose pentaoleate and the like. Suitable materials include some of the Ryoto series available from Mitsubishi Kagaku Foods Corporation.

The liquid or soft solid derivative-CPs and derivative-RSs are characterised as materials having a solid:liquid ratio of between 50:50 and 0:100 at 20° C. as determined by $T_2$ relaxation time NMR, preferably between 43:57 and 0:100, most preferably between 40:60 and 0:100, such as, 20:80 and 0:100, The $T_2$ NMR relaxation time is commonly used for characterising solid:liquid ratios in soft solid products such as fats and margarines. For the purpose of the present invention, any component of the NMR signal with a $T_2$ of less than 100 microsecond is considered to be a solid component and any component with $T_2$ greater than 100 microseconds is considered to be a liquid component.

The liquid or soft solid derivative-CPE and derivative-RSE can be prepared by a variety of methods well known to those skilled in the art. These methods include acylation of the cyclic polyol or of a reduced saccharide with an acid chloride; trans-esterification of the cyclic polyol or of a reduced saccharide material with short chain fatty acid esters in the presence of a basic catalyst (e.g. KOH); acylation of the cyclic polyol or of a reduced saccharide with an acid anhydride, and, acylation of the cyclic polyol or of a reduced saccharide with a fatty acid. Typical preparations of these materials are disclosed in U.S. Pat. No. 4,386,213 and AU 14416/88 (Procter and Gamble).

The compositions comprise between 1%-15% wt of alkylated sugar, preferably 3-10% wt, based on the total weight of the composition.

Fatty Acid

A fatty acid is present in the composition.

Any reference to "fatty acid" herein means "free fatty acid" unless otherwise stated and it is to be understood that any fatty acid which is reacted with another ingredient is not defined as a fatty acid in the final composition, except insofar as free fatty acid remains after the reaction.

Preferred fatty acids are those where the weighted average number of carbons in the alkyl/alkenyl chains is from 8 to 24, more preferably from 10 to 22, most preferably from 12 to 18.

The fatty acid can be saturated or unsaturated.

The fatty acid may be an alkyl or alkenyl mono- or polycarboxylic acid, though monocarboxylic acids are particularly preferred.

The fatty acid can be linear or branched. Non-limiting examples of suitable branching groups include alkyl or alkenyl groups having from 1 to 8 carbon atoms, hydroxyl groups, amines, amides, and nitriles.

Suitable fatty acids include both linear and branched stearic, oleic, lauric, linoleic, and tallow—especially hardened tallow—acids, and mixtures thereof.

The amount of free fatty acid is preferably from 1 to 15 wt %, preferably from 2 to 5 wt %, based on the total weight of the composition.

Fatty Acid Ester

The composition comprises one or more fatty acid esters. Suitable fatty acid esters are fatty esters of mono or polyhydric alcohols having from 8 to about 24 carbon atoms in the fatty acid chain. Such fatty esters are preferably substantially odourless.

The fatty acid ester is present in an amount of from 5 to 25 wt %, preferably 8 to 20 wt %, based on the total weight of the composition.

Fatty Acid Soap

A fatty acid soap is present in the composition.

Useful soap compounds include the alkali metal soaps such as the sodium, potassium, ammonium and substituted ammonium (for example monoethanolamine) salts or any combinations of this, of higher fatty acids containing from about 8 to 24 carbon atoms.

In a preferred embodiment of the invention the fatty acid soap has a carbon chain length of from $C_{10}$ to $C_{22}$, more preferably $C_{12}$ to $C_{20}$.

Suitable fatty acids can be obtained from natural sources such as plant or animal esters e.g. palm oil, coconut oil, babassu oil, soybean oil, caster oil, rape seed oil, sunflower oil, cottonseed oil, tallow, fish oils, grease lard and mixtures thereof. Also fatty acids can be produced by synthetic means such as the oxidation of petroleum, or hydrogenation of carbon monoxide by the Fischer Tropsch process. Resin acids are suitable such as rosin and those resin acids in tall oil. Naphthenic acids are also suitable. Sodium and potassium soaps can be made by direct saponification of the fats and oils or by the neutralisation of the free fatty acids which are prepared in a separate manufacturing process.

Particularly useful are the sodium and potassium salts and the mixtures of fatty acids derived from coconut oil and tallow, i.e. sodium tallow soap, sodium coconut soap, potassium tallow soap, potassium coconut soap.

For example Prifac 5908 a fatty acid from Uniqema which was neutralised with caustic soda. This soap is an example of a fully hardened or saturated lauric soaps which in general is based on coconut or palm kernel oil.

Also mixtures of coconut or palm kernel oil and for example palm oil, olive oil, or tallow can be used. In this case more palmitate with 16 carbon atoms, stearate with 18 carbon atoms, palmitoleate with 16 carbon atoms and with one double bond, oleate with 18 carbon atoms and with one double bond and/or linoleate with 18 carbon atoms and with two double bonds are present.

Thus, the soap may be saturated or unsaturated

It is particularly preferred that the alkali metal hydroxide is potassium or sodium hydroxide, especially potassium hydroxide.

The fatty acid soap is present at a level of from 1 to 15 wt %, more preferably from 3 to 10 wt %, based on the total weight of the composition.

The soap is preferably formed in situ.

The method of preparing the soap comprises the steps of reacting together, in the presence of water, an ester-containing soap precursor, a base material, and optionally a solvent to produce one or more soaps and a plasticiser.

Ester-containing Soap Precursor

The precursor is an agent which, under the desired conditions, liberates soap and a lower alcohol plasticiser.

Particularly preferred ester-containing soap precursors include fatty acid esters, particularly fatty acid triglycerides and alkylated sugar esters, particularly sucrose polyesters as described above.

Base Material

A base, which may be either inorganic or organic.

Inorganic bases are particularly preferred. Suitable examples of inorganic bases include alkali metal hydroxides or alkaline earth metal hydroxides. Potassium hydroxide and sodium hydroxide are particularly preferred.

Organic bases suitable for use in the method of the present invention include secondary, and tertiary amines, such as dimethylamine and triethanolamine.

The soap may be prepared in premix from which the final composition is prepared. It is preferred that the level of base material is from 0.5 to 20 wt %, more preferably from 2 to 15 wt %, most preferably from 4 to 10 wt %, e.g. from 5 to 8 wt %, based on the total weight of the premix. It is preferred that the level of ester-containing soap precursor is from 0.5 to 60 wt %, more preferably from 2 to 30 wt %, most preferably from 5 to 20 wt %, e.g. from 8 to 15 wt %, based on the total weight of the premix.

In the reaction, it is preferred that the weight ratio of ester-containing soap precursor to base material is from 80 to 1, more preferably from 60 to 1, most preferably from 30 to 1, e.g. from 15 to 1.

Water in the Premix

The reaction takes place in the presence of water.

It is preferred that the level of water in the premix is from 0.1 to 20 wt %, more preferably from 1 to 10 wt %, most preferably from 2 to 5 wt %, e.g. from 1 to 4 wt %, based on the total weight of the premix.

Solvent

Solvents can be present in the premix and/or the final composition. Preferred solvents include ethers, polyethers, alkylamines and fatty amines, (especially di- and trialkyl- and/or fatty-N-substituted amines), alkyl (or fatty) amides and mono- and di-N-alkyl substituted derivatives thereof, alkyl (or fatty) carboxylic acid lower alkyl esters, ketones, aldehydes, polyols, and glycerides.

Specific examples include respectively, di-alkyl ethers, polyethylene glycols, alkyl ketones (such as acetone) and glyceryl trialkylcarboxylates (such as glyceryl tri-acetate), glycerol, propylene glycol, dipropylene glycol and sorbitol. Dipropylene glycol is particularly preferred.

Glycerol is particularly preferred since it provides the additional benefit of plasticising the water soluble film.

Other suitable solvents are lower (C14) alcohols, such as ethanol, or higher (C5-9) alcohols, such as hexanol, as well as alkanes and olefins. It is often desirable to include them for lowering the viscosity of the product and/or assisting soil removal during cleaning.

Preferably, the solvent is present in the premix at a level of at least 0.1% by weight of the total premix. The amount of the solvent present may be as high as about 60%, but in most cases the practical amount will lie between 1 and 30% and sometimes, between 2 and 20% by weight of the premix.

In the final composition the amount of solvent is generally from 1 to 15 wt %, preferably 2 to 7 wt %, based on the total weight of the composition.

It is to be understood that certain solvents which are also plasticisers, e.g. lower alcohols and polyols, can also be produced by the reaction of the soap precursor and base material. Such plasticisers are described below.

Reaction Conditions

It is desirable that the reaction takes place at elevated temperature. In particular, the reaction is preferably carried out at a temperature of from 50 to 100° C., more preferably 60 to 80° C. in order that the process is more economically viable.

In a most preferred method, the soap precursor is heated to 60 to 80° C., after which the base material is added and the mixture stirred for between 10 minutes and 4 hours. After this time, other ingredients are added.

Plasticiser

The reaction of the soap precursor and the base material preferably liberate a plasticiser. Typically the plasticiser is a lower alcohol.

Examples of plasticisers which can be produced by the method of the invention include lower (C1-4) alcohols, such as ethanol, or higher (C5-9) alcohols, such as hexanol, as well as polyols such as glycerol.

Preferably, the level of plasticiser is at least 0.1% by weight of the total composition. The amount of the solvent present in the composition may be as high as about 60%, but in most cases the practical amount will lie between 1 and 30% and sometimes, between 2 and 20% by weight of the composition.

Nonionic Surfactant

Nonionic surfactants suitable for use in the compositions include any of the alkoxylated materials of the particular type described hereinafter can be used as the nonionic surfactant.

Substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula for the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 3, preferably about 5, more preferably at least about 7 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$ EO(11). The ethoxylates of mixed natural or synthetic alcohols in the "tallow" chain length range are also useful herein. Specific examples of such materials include tallow alcohol-EO(11), tallow alcohol-EO(18), and tallow alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$EO(14).

C. Alkyl Phenol Alkoxylates

As in the case of the alcohol alkoxylates, the hexa- to octadeca-ethoxylates of alkylated phenols, particularly monohydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

The above ethoxylated nonionic surfactants are useful in the present compositions alone or in combination, and the term "nonionic surfactant" encompasses mixed nonionic surface active agents.

The nonionic surfactant is preferably present in an amount from 0.1 to 5%, more preferably 0.5 to 2% by weight, based on the total weight of the composition.

Perfume

It is desirable that the compositions of the present invention also comprise one or more perfumes. Suitable perfume ingredients include those disclosed in "Perfume and Flavour Chemicals (Aroma Chemicals)", by Steffen Arctander, published by the author in 1969, the contents of which are incorporated herein by reference.

The perfume is preferably present in the composition at a level of from 0.1 to 15 wt %, more preferably from 0.5 to 5 wt % based on the total weight of the composition.

As used herein and in the appended claims the term "perfume" is used in its ordinary sense to refer to and include any non-water soluble fragrant substance or mixture of substances including natural (i.e. obtained by extraction of flower, herb, blossom or plant), artificial (i.e. mixture of natural oils or oil constituents) and synthetically produced odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 1% to 70% by weight, the essential oils themselves being volatile odoriferous compounds and also serving to dissolve the other components of the perfume.

Cationic Polymer

It is desirable that the composition further comprises a cationic polymer. The cationic polymer significantly boosts softening performance on fabrics delivered by the composition.

A particularly preferred class of cationic polymer is cationic celloluse ethers. Such ethers are commercially available under the tradename Ucare LR-400 ([2-hydroxy-3(trimethylammonio)propyl]-w-hydroxypoly(oxy-1,2-ethanediyl) chloride) or the Jaguar polymers such as Guar hydroxypropyl trimonium chloride, Jaguar C13 ex Rhodia.

The polymer is preferably present at a level of from 0.1 to 5 wt %, more preferably from 0.2 to 2 wt %, most preferably from 0.25 to 1 wt %, based on the total weight of the composition.

Water

The final composition comprises from 50 to 92 wt %, more preferably from 70 to 95 wt % based on the total weight of the composition.

Cationic Surfactants

The compositions of the invention are preferably substantially free, more preferably entirely free of cationic surfactants, since the compositions are primarily for use in the wash cycle of an automatic washing machine. Thus, it is preferred that the maximum amount of cationic surfactant present in the composition is 5 wt % or less, more preferably 4 wt % or less, even more preferably 3 wt % or less, most preferably 2 wt % or less, e.g. 1 wt % or less, based on the total weight of the composition.

It is well known that anionic surfactants are typically present in the wash detergent and so would complex undesirably with any cationic surfactant in the composition thereby reducing the effectiveness of the wash detergent.

Other Optional Ingredients

The compositions may also contain one or more optional ingredients conventionally included in fabric treatment compositions such as pH buffering agents, perfume carriers, fluorescers, colourants, hydrotropes, antifoaming agents, antiredeposition agents, polyelectrolytes, enzymes, optical brightening agents, pearlescers, anti-shrinking agents, anti-wrinkle agents, anti-spotting agents, germicides, fungicides, anti-corrosion agents, drape imparting agents, anti-static agents, ironing aids crystal growth inhibitors, anti-oxidants, anti-reducing agents, dyes, and water activity modifiers such as sugars, salts, proteins and water soluble homo- and copolymers.

Product Form

The product is in the form of a liquid which is provided to the customer in conventional containers, such as bottles, sachets etc. The composition may be concentrated providing the customer with the opportunity to dilute the composition with water and store the diluted composition prior to use. The composition may be dosed directly into the rinse water in hand washing or a washing machine or may be dosed in a drawer of an automatic washing machine.

In a further embodiment a super-concentrate may be prepared by substantially reducing the water content e.g. at least 4 fold or even to a substantially anhydrous composition. The super-concentrate may be shipped to appropriate destinations, thereby saving shipping costs, where it is diluted with water, generally by simple agitation at room temperature, to form compositions to be provided to the customer.

EXAMPLE

The following Example illustrates a liquid laundry treatment compositions used in the invention.

Unless otherwise specified, the amounts and proportions in the compositions and films are by weight.

Example 1

Preparation of a Fabric Treatment Composition According to the Invention

A composition was prepared using the following ingredients:

TABLE 1 composition of Example 1

| Ingredients | wt % added | wt % after soap formation |
|---|---|---|
| Coconut Oil | 20.5 | 15.80 |
| DPG (1) | 6.00 | 6.00 |
| Pristerene 4916 (2) | 3.20 | 2.40 |
| Potassium Stearate | — | 0.91 |
| Potassium cocoate | — | 5.50 |
| Genapol C-200 (3) | 1.34 | 1.34 |
| Baypure CX100 (4) | 0.30 | 0.30 |
| BHT (5) | 0.05 | 0.05 |
| Dye | 0.04 | 0.04 |
| Danox SCR-32 (6) | 4.26 | 4.26 |
| Perfume | 1.0 | 1.00 |
| Waters[a] | 60.45 | 61.67 |
| Preservative | 0.04 | 0.04 |
| Glycerol | — | 0.67 |
| KOH (50% solution) | 2.80 | — |
| Antifoam | 0.02 | 0.02 |

(1) dipropylene glycol
(2) hardened talllow fatty acid ex Uniqema
(3) coco alcohol ethoxylate containing an average degree of ethoxylation of 20
(4) sequesterant; sodium iminosuccinate ex Bayer; 2,6-dibutyl-4-methyl phenol
(5) anti-foam ex. Dow Corning
(6) sugar ester-palm kernalate The formulation was prepared as follows:

1. The DPG Coconut oil and 0.8% Stearic acid were heated together to 60-65° C.
2. Whilst mixing slowly the KOH solution was added and mixed for a few minutes until fully saponified. The mixture turned from hazy to clear.
3. The remaining 2.4% Stearic acid was added and mixed until melted.
4. The water was heated to 60-65° C. and added to mix, followed by the antifoam.
5. The mixture was cooled to 50° C. after mixing the Danox and Nonionic added.
6. At 40° C. the perfume and minors were added.

Examples 2 and 3

Preparation of a Concentrated Fabric Treatment Composition According to the Invention, a Ready to Use Fabric Treatment Composition According to the Invention and Comparative Example A The three compositions were prepared using the following ingredients:

TABLE 2 composition of Examples 2, 3 and comparative example A

| | wt % added | | |
|---|---|---|---|
| Ingredients | Example 2 (concentrated) | Example 3 (ready to use) | Comparative Example A |
| Coconut Oil | 16.1 | 5.8 | 0 |
| DPG (1) | 16.7 | 6 | 0 |
| Baypure CX100 (2) | 0.67 | 0.24 | 0 |
| Danox SCR-32 (3) | 41.7 | 15 | 15 |
| Perfume | 4.1 | 1.47 | 0 |
| KOH (50% solution) | 3.9 | 1.4 | 0 |
| CTAC (4) | 0 | 0 | 3 |
| Stearic acid (5) | 8.9 | 3.2 | 0 |

TABLE 2-continued composition of Examples 2, 3 and comparative example A

| Ingredients | wt % added Example 2 (concentrated) | Example 3 (ready to use) | Comparative Example A |
|---|---|---|---|
| Neodol 25-7 | 4.4 | 1.6 | 0 |
| water | to 100% | to 100% | to 100% |

(1) dipropylene glycol
(2) sequesterant; sodium iminosuccinate, ex Bayer; 2,6-dibutyl-4-methyl phenol
(3) sugar ester-palm kernalate
(4) CetylTriAmmoniumChloride, ex-Aldrich
(5) ex Aldrich
(6) 7 EO non-ionic surfactant, t ex-Shell The formulations were prepared as follows:

1. The DPG Coconut oil and 0.8% Stearic acid were heated together to 60-65° C.
2. Whilst mixing slowly the KOH solution was added and mixed for a few minutes until fully saponified. The mixture turned from hazy to clear.
3. The remaining Stearic acid was added and mixed until melted.
4. The water was heated to 60-65° C. and added to the mixture.
5. The mixture was cooled to 50° C. after mixing the Danox and Nonionic added.
6. At 40° C. the perfume was added.

Example 4

Sucrose Polyester Deposition from Formulations of Examples 2 and 3 and Comparative Example A Onto Polyester Evaluation of Sucrose Polyester (SPE) deposition was carried out using a colormetric method by incorporating 0.5% Oil Red Dye (ex-Aldrich) into the SPE prior to addition to the formulation.

The fabric used for the evaluation was white polyester. 1 g of ready to use conditioner (or 0.36 g of Example 2, thus giving an equivalent amount of SPE) was added to 1 litre of Wirral water (12-15 degrees French Hard) in a tergo pot, to which 2×10 g pieces of fabric were added and agitated for 5 minutes. The fabric was then removed from the pot, spun dry and left to dry fully on a drying rack at ambient temperature and humidity.

Measurement of the dye intensity was carried out using a reflectometer (Datacolor Spectroflash 600+). Red intensity was then measured as an indication of the level of deposition of SPE onto the fabric samples.

Deposition Results a and b Parameters:

a is a measure of redness (a negative value indicates the colour lies towards green whilst a positive value indicates red)

b is a measure of yellowness (a negative value indicates the colour lies towards blue whilst a positive value indicates yellow)

TABLE 3 deposition of SPE from conditioners Example 2, Example 3 and Comparative Example A

| | a | b |
|---|---|---|
| Standard (water rinse only) | −0.39 | 1.14 |
| Example 2 | | |
| run 1 | 12.8 | −0.48 |
| run 2 | 10.94 | −0.72 |
| run 3 | 11.68 | −0.71 |
| average | 11.81 | −0.64 |
| Example 3 | | |
| run 1 | 11.91 | −0.39 |
| run 2 | 9.07 | −0.46 |
| run 3 | 9.93 | −0.32 |
| average | 10.3 | −0.39 |
| Comparative Example A | | |
| run 1 | 0.68 | 1.61 |
| run 2 | 1.31 | 1.76 |
| run 3 | 1.31 | 1.66 |
| average | 1.1 | 1.68 |

It will be seen that the best deposition comes from the compositions according to the invention.

Example 5

Sensory Evaluation Using the Formulation of Example 1

A sensory evaluation was performed to evaluate perfume deposition from conditioners according to Example 1 onto cotton sheeting, polycotton, polyester and terry towelling, after a tergo wash similar to that described above. Commercially available Comfort was used as a comparative example.

The results are given in the following table:

TABLE 4 perfume deposition from conditioners Example 1 and Comfort.

| | Cotton sheeting | poly-cotton | poly-ester | terry towelling |
|---|---|---|---|---|
| Example 1 | 1.67 | 2.58 | 2.25 | 1.5 |
| Comfort | 0.67 | 1.25 | 1.17 | 1.33 |

It will be seen that perfume deposition is superior from the composition of the invention on every type of fabric tested.

We claim:

1. A liquid fabric treatment composition comprising:

(i) from 50 to 92% by weight of water;

(ii) from 1 to 15% by weight of one or more sugars that has been derivatised by esterification or etherification with an alkyl or alkenyl chain;

(iii) from 1 to 15% by weight of one or more fatty acids;

(iv) from 5 to 25% by weight of one or more fatty acid esters; and (v) from 1 to 15% by weight of fatty acid soap.

2. A composition as claimed in claim 1 in which the fatty acid is present in an amount from 2 to 5% by weight based on the total weight of the composition.

3. A composition according to claim 1 wherein said derivatised sugar is present in an amount of from 3 to 10 wt % based on the total weight of the composition.

4. A composition according to claim 1 in which the fatty acid soap is present in an amount from 3 to 10% by weight based on the total composition.

5. A composition according to claim 1 wherein the fatty acid ester is derived from coconut oil.

6. A method according to claim 5 wherein the fatty acid ester is a fatty acid triglyceride.

7. A composition according to claim 1 wherein said sugar has been derivatised by esterification with an alkyl or alkenyl chain.

8. A composition according to claim 1 wherein said sugar has been derivatised by etherification with an alkyl or alkenyl chain.

9. A composition according to claim 1 wherein the fatty acid ester is derived from palm kernel oil.

10. A composition according to claim 1 which additionally comprises the cationic cellulose ether deposition polymer in an amount of from 0.1 to 5% by weight based on the total weight of the composition.

11. A composition according to claim 1 wherein the amount of water is from 70 to 92% by weight based on the total weight of the composition.

12. A method of preparing a composition as claimed in claim 1 which includes preparing the soap in situ by the steps of reacting together in the presence of water, an ester-containing soap precursor, a base material, and optionally a solvent.

13. A method according to claim 12 wherein the reaction is carried out at a temperature of from 50 to 100° C.

14. A method according to claim 12 wherein the ester-containing soap precursor is a sugar that has been derivatised by esterification with an alkyl or alkenyl chain.

15. A method according to claim 14 wherein said derivatised sugar ester is a sucrose polyester.

16. A method according to claim 12 wherein the ester-containing soap precursor is a fatty acid ester.

17. A method according to claim 12 wherein the base material is an inorganic base.

18. A method according to claim 17 wherein the base material is an alkali metal hydroxide.

19. A method according to claim 12 wherein the base material is an organic base.

20. A method according to claim 12 wherein the reaction is carried out at a temperature of from 60 to 80° C.

* * * * *